US005337797A

United States Patent [19]

Janssen et al.

[11] Patent Number: 5,337,797

[45] Date of Patent: Aug. 16, 1994

[54] HYDROCARBON DISPENSER NOZZLE

[75] Inventors: Sylvain Janssen, Neuilly s/Seine; Jacques Fournier, Bretigny S/Orge; Claude Larmurier, Paris, all of France

[73] Assignee: Schlumberger Industries, Montrouge, France

[21] Appl. No.: 786,097

[22] Filed: Oct. 31, 1991

[30] Foreign Application Priority Data

Nov. 2, 1990 [FR] France ..... 90 13622

[51] Int. Cl.[5] ..... B65B 57/14

[52] U.S. Cl. ..... 141/206; 141/46; 141/215; 251/12

[58] Field of Search ..... 141/46, 192, 198, 206, 141/209, 210, 214, 215, 217, 227, 228; 251/36, 12

[56] References Cited

U.S. PATENT DOCUMENTS

| | | | |
|---|---|---|---|
| 1,392,632 | 10/1921 | Flanders | 141/217 X |
| 2,363,123 | 11/1944 | Franck | 141/215 X |
| 2,620,776 | 12/1952 | Groves | 251/36 X |
| 2,705,102 | 3/1955 | Slattery | 141/227 |
| 2,869,584 | 1/1959 | Gordon . | |
| 3,156,271 | 11/1964 | Schnurmann | 141/217 X |
| 3,241,567 | 3/1966 | Pusch et al. | 251/36 X |
| 3,823,752 | 7/1974 | Lasater et al. | 141/217 |
| 4,106,536 | 8/1978 | Coquerel | 141/229 X |
| 4,201,052 | 5/1980 | Breeden et al. . | |
| 4,213,488 | 7/1980 | Pyle . | |
| 4,282,895 | 8/1981 | Young | 251/36 X |
| 4,365,647 | 12/1982 | Taylor et al. . | |
| 4,405,001 | 9/1983 | Sugiyama et al. | 141/229 |
| 4,559,982 | 12/1985 | Fink, Jr. | 141/206 |

FOREIGN PATENT DOCUMENTS 2015704A 9/1979 United Kingdom .

*Primary Examiner*—Allan N. Shoap
*Assistant Examiner*—Christopher McDonald
*Attorney, Agent, or Firm*—Frishauf, Holtz, Goodman & Woodward

[57] ABSTRACT

A system that provides assistance in opening the main valve in a hydrocarbon dispenser nozzle. The external control member for opening the main valve acts on a pilot valve of small flow section, with the main valve being opened by fluid pressure applied to it as a result of the pilot valve being opened. The seat of the pilot valve is formed in the main valve member.

8 Claims, 5 Drawing Sheets

HYDROCARBON DISPENSER NOZZLE

BACKGROUND OF THE INVENTION

The present invention relates to a hydrocarbon dispenser nozzle and, more particularly, to an improved control system for the nozzle which prevents unauthorized dispensing of hydrocarbon as well as unintended spillage thereof.

Hydrocarbon dispenser nozzles are becoming more and more complex, firstly to avoid unwanted flows of hydrocarbon under various circumstances, and secondly to avoid various types of fraud being perpetrated by the user.

The risk of unwanted hydrocarbon flow occur in particular under the following two circumstances:

Firstly, when the nozzle is in its rest position with its orifice pointing upwards, the hose associated with the nozzle is always kept under pressure even when the pump is stopped. If a leak occurs in this position because of the pressure, then the hydrocarbon spreads over the handle of the nozzle and this is naturally very disagreeable for the user.

Secondly, when a user takes hold of the nozzle in certain types of installations, there may be relatively high pressure in the hose. In this case there may also occur a flow of hydrocarbon.

One known fraud, applicable to a nozzle that includes a downstream valve that opens under pressure, consists of jumping on the hose of the nozzle to create excess pressure that will give rise to fraudulent opening of the valve.

The solutions generally used for avoiding such unwanted flows of hydrocarbon or for preventing such fraud involve either increasing the force of the return spring on the valve or else using an upstream valve that tends to close with increasing pressure.

In both cases, the force the user needs to exert on the trigger of the dispenser nozzle to obtain hydrocarbon delivery is very significantly increased. This can create difficulties with certain categories of user.

Another way in which unwanted flow of hydrocarbon may happen occurs when the user withdraws the nozzle from the vehicle tank after filling the tank. The fraction of hydrocarbon that remains in the cavity between the valve and the end of the nozzle tube can be considerable, and depends on the angle of inclination of the tube, and this volume may spill out under gravity onto the ground when the user removes the nozzle from the tank of the vehicle.

SUMMARY OF THE INVENTION

An object of the invention is to provide a hydrocarbon dispenser nozzle having a control system that only requires a small force to actuate the trigger of the nozzle.

According to the invention, this object is achieved by a hydrocarbon dispenser nozzle comprising a main valve for interrupting the flow of hydrocarbon between an upstream portion of the nozzle and a downstream portion thereof, and an external control member for controlling the opening of said main valve, wherein the control member acts on a pilot valve having a passage of small section, and whose opening causes said main valve to open.

Another object of the invention is to provide a hydrocarbon dispenser nozzle that prevents spillage of hydrocarbon which remains in the end of the nozzle tube downstream of the main valve.

In a preferred embodiment of the invention that also serves to solve the above problem, the dispenser nozzle further includes an end valve mounted at the open end of said nozzle, and in that opening said pilot valve causes said end valve to open before said main valve is opened, and causes said end valve to close after said main valve has closed.

BRIEF DESCRIPTION OF THE DRAWINGS

Embodiments of the invention are described by way of example with reference to the accompanying drawings, in which.

DETAILED DESCRIPTION OF THE INVENTION

Figure 1:
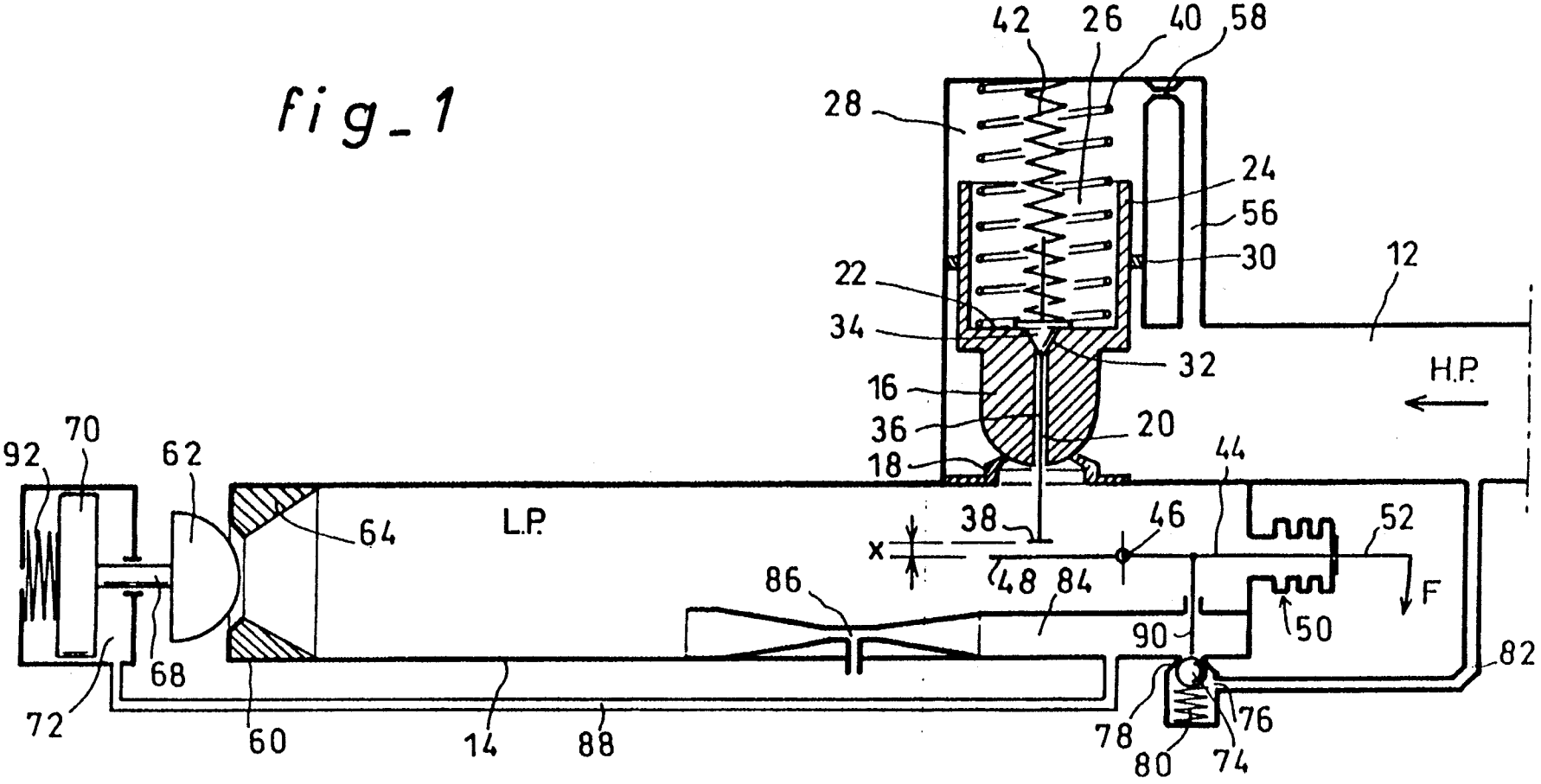
FIG. 1 is a longitudinal cross section through a first embodiment of a dispenser nozzle of the invention.

A first embodiment of a hydrocarbon dispenser nozzle is initially described with reference to FIG. 1. This figure shows the nozzle diagrammatically so as to facilitate understanding of its various parts.

The nozzle comprises an upstream portion 12 which is connected to a flexible hose (not shown), and a downstream portion 14 defining the end tube of the nozzle which is designated to be inserted into the vehicle tank. The upstream and downstream portions 12 and 14 are separated by a main valve member 16 which co-operates with a seat 18. When the valve member 16 bears against its seat 18, liquid cannot flow from the upstream portion to the downstream portion.

The main valve member 16 is pierced by an axial orifice 20. The non-active face 22 of the main valve member 16 is extended by a cylindrical skirt 24 defining a main volume 26. The skirt 24 is slidably mounted in a cylindrical chamber 28. A low friction gasket 30 secured to the outside face of the skirt 24 provides sealing between the skirt 24 and the wall of the cylindrical chamber 28.

The end of the axial orifice 20 that opens out in the face 22 of the valve member 16 forms a seat 32 for a pilot valve member 34 which is fixed at a first end of a rod 36 slidably mounted in the axial orifice 20. The other end 38 of the rod 36 is free. The main valve member 16 is held against its seat 18 by a return spring 40, and the pilot valve member 34 is held against its seat 32 by a second return spring 42.

The control member of the nozzle (corresponding to the conventional trigger) is represented in FIG. 1 by a rod 44 pivotally mounted about an axis 46 extending perpendicularly to the rod 44. The rod 44 passes through the wall of the downstream portion of the nozzle via deformable bellows 50. To operate the nozzle, a user acts on the end 52 of the rod 44 in the direction of arrow F. The other end 48 of the rod 44, when at rest, is at a short distance x from the end 38 of the rod 36 which is secured to the pilot valve member 34.

The upstream portion 12 of the nozzle which is at high pressure (HP) is connected via a duct 56 to the cylindrical chamber 28 in which the skirt 24 of the main valve member 16 is received. A restriction 58 for creating a large hydraulic head loss is mounted in the duct 56.

The dispenser nozzle control member operates as follows. At rest, i.e. when no action is taken on the control rod 44, the high pressure HP that exists in the upstream portion 12 of the nozzle also exists in the volume 26 defined by the skirt 24.

This high pressure thus tends to hold the main valve member 16 against its seat 18 and the pilot valve member 34 against its seat 32, with this pressure adding to the effect of return springs 40 and 42. It can thus be seen that the greater the increase in upstream pressure, the greater the force tending to keep the main valve member and the pilot valve member closed.

If action is applied to the rod 44 in the direction of arrow F, the resulting displacement has no effect until the end 48 of the rod makes contact with the end 38 of the rod 36 which is secured to the pilot valve member 34. When the rod 36 is displaced, the pilot valve member 34 is lifted off its seat 32 and compresses the spring 42. A flow of liquid thus takes place through the orifice 20 in the valve member 16 because of the difference between the high pressure (HP) within the volume 26 and the low pressure (LP) in the downstream portion 14 of the nozzle. This flow of liquid establishes a pressure difference on either side of the restriction 58. As a result the pressure within the chamber 28 and the volume 26 becomes less than the high pressure HP. This "middle" pressure is written MP.

Under these conditions, the force F1 exerted on the top portion of the valve member and urging it against its seat is reduced while the high pressure continues to exert a force F2 on the bottom portion thereof, which now tends to lift it off its seat.

Once the pilot valve member 34 has been raised sufficiently to lower the pressure MP sufficiently, the balance between the forces F1 and F2 reaches a point where the main valve member is lifted off its seat.

From this position, if further displacement is rapidly applied to the pilot valve member 34, then the distance between the pilot valve member 34 and its seat 32 increases, thereby increasing the flow rate through the channel 20 and thus reducing MP. The main valve member 16 leaves its seat and moves towards the pilot valve member 34, thereby reducing the distance 32–34 until a new balance of forces is achieved. In this operation, the main valve member 16 follows the pilot valve member 34 to allow fluid to pass. The main valve member is thus opened by causing it to pursue the pilot valve member.

It must be emphasized that the control rod 44 serves only to displace the pilot valve member 34 which is very small in section. The force that the user is required to exert is therefore itself very small. If the control rod 44 is then released, the pilot valve member 34 returns to its seat 32 under drive from its spring, thereby closing the chamber 28. The middle pressure MP in the chamber 28 therefore tends to increase having the effect of progressively closing the main valve member 16.

The above description relates solely to control of the main valve of the nozzle. In the embodiment shown in FIG. 1, the nozzle further includes an end valve 62 at the end 60 of the tube 14 for the purpose of preventing dripping when the nozzle is removed from a vehicle tank. The valve member 62 of the end valve is mounted on a rod 68 which is in turn mounted on a piston 70 mounted to slide in sealed manner in a chamber 72. In FIG. 1, the valve member 62 and the chamber 72 are shown as being outside the tube 14 in order to simplify the drawing. It will naturally be understood that in fact these two members are disposed inside the tube 14.

As shown in FIG. 1, the nozzle further includes a ball valve mounted in a chamber 76. The ball 74 of the valve co-operates with a seat 78 against which it is urged by a return spring 80. The chamber 76 is connected to the upstream portion 12 of the nozzle via a duct 82. The chamber 76 can communicate with the upstream portion 84 of a venturi system 86. The upstream portion 84 is connected by a tube 88 to the chamber 72. In addition, the above-described control rod 44 includes a finger 90 which, when action is taken on the control rod 44, tends to move the ball 74 off its seat 78, compressing its return spring 80.

When the control rod 44 is at rest, the ball 74 is held against its seat 78 and the chamber 72 is thus at the low pressure that obtains in the downstream portion 14 of the nozzle. The spring 92 thus serves to urge the end valve member 62 against its seat 64. When the user actuates the control rod 44 in the direction of arrow F, the finger 90 comes into contact with the ball 74 before the end of the rod 44 comes into contact with the end 38 of the rod 36 connected to the pilot valve 32 because of lost motion x. When the ball 74 is moved off its seat 78 by the finger 90, the high pressure in the upstream portion 12 of the nozzle enters the chamber 72 via the tube 88. The high pressure acting on the piston 72 moves the end valve member 62 off its seat, thereby opening the end 66 of the nozzle. The nozzle is therefore ready to allow hydrocarbon to flow as soon as the main valve opens in the manner described above.

Figure 2:
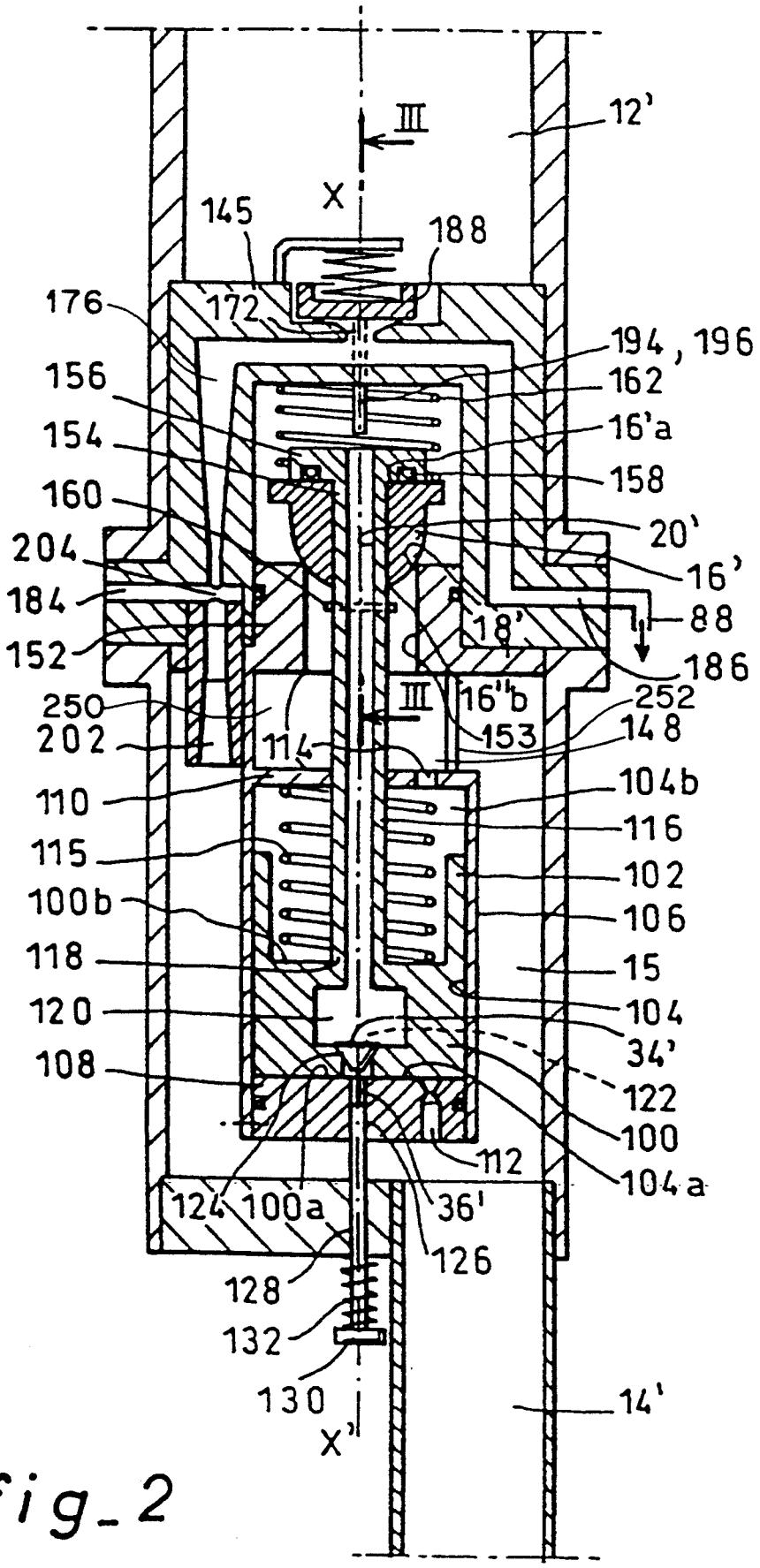
FIG. 2 is a longitudinal cross section through a second embodiment of a dispenser nozzle of the invention.
Figure 3:
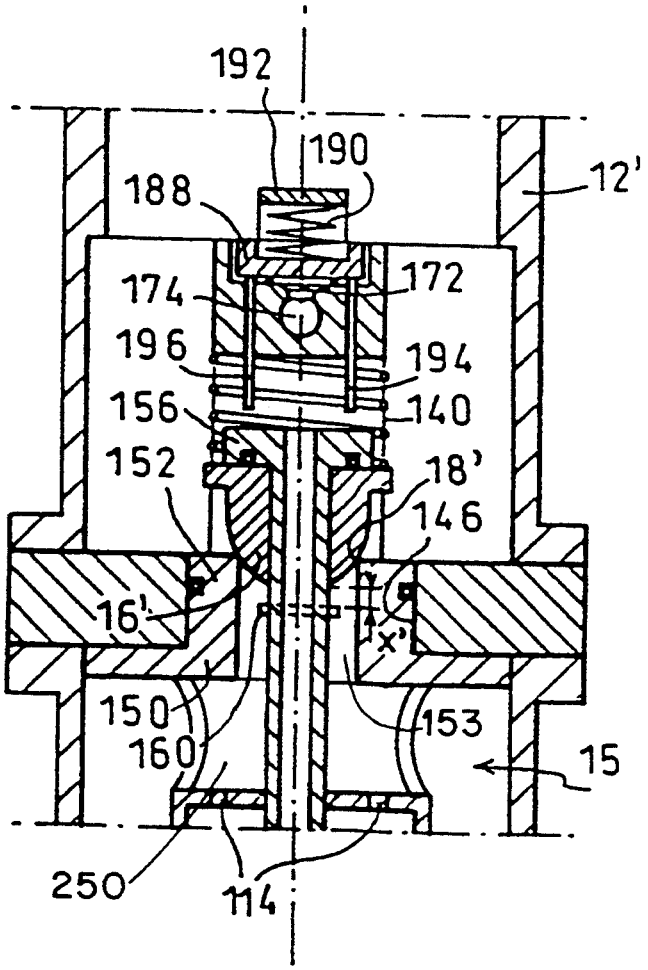
FIG. 3 is a fragmentary longitudinal section taken along line III—III of FIG. 2.
Figure 4:
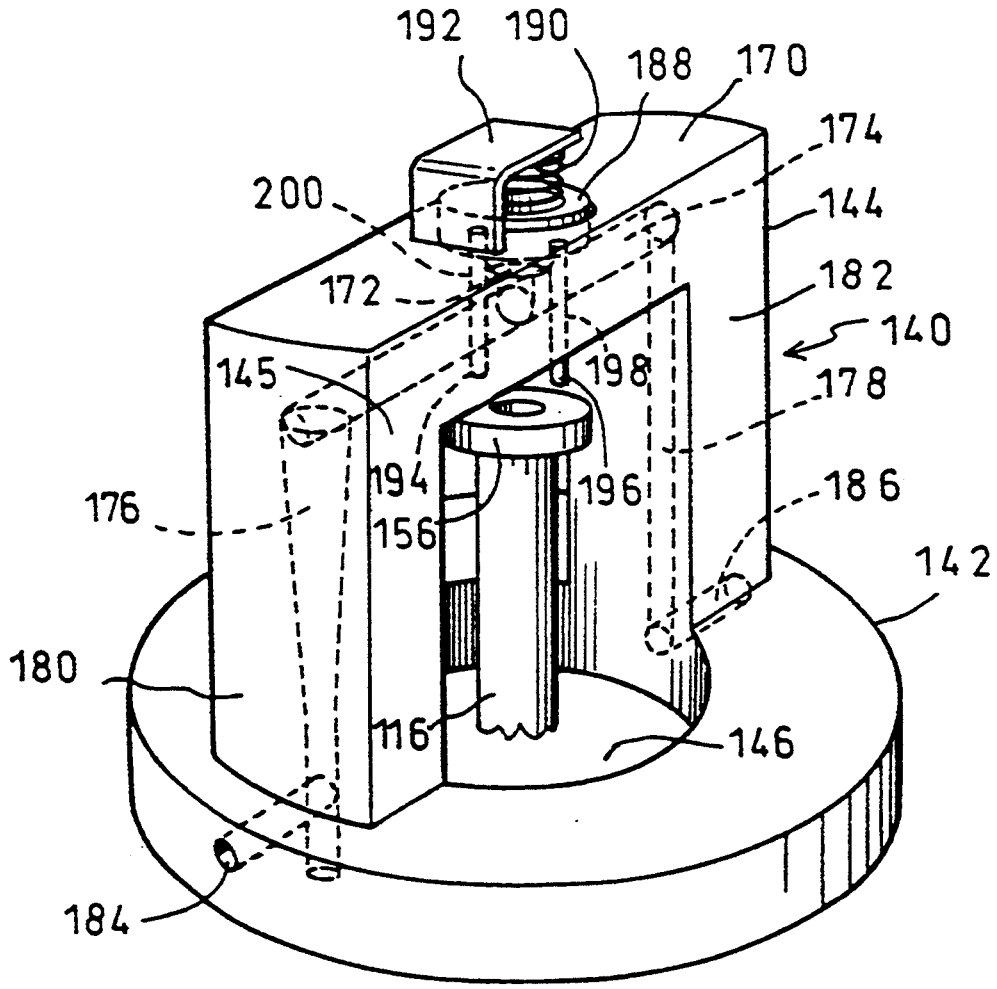
FIG. 4 is a fragmentary perspective view corresponding to the portion of the nozzle shown in FIG. 3.

With reference now to FIGS. 2 to 4, a second implementation of assisted control for a hydrocarbon dispensing nozzle is described.

In FIG. 2, there can be seen a dispenser nozzle comprising an upstream portion 12' connected to a hose (not shown) and a downstream portion 14' which defines the end tube of the nozzle that is inserted into the hydrocarbon tank of a vehicle. The upstream and downstream portions 12' and 14' of the nozzle are interconnected via a chamber 15 which contains the nozzle control mechanism. The control mechanism includes a main valve member 16'. The main valve member 16' co-operates with a fixed seat 18'. The main valve member 16' has an axial bore 20'. Inside the chamber 15, between the downstream portion 14' of the nozzle and the seat 18' of the main valve member 16', there is a control piston 100 extended by a circular skirt 102. The piston 100 slides in sealed manner inside a fixed cylindrical chamber 104. The chamber 104 is delimited by a cylindrical side wall 106, by a first end wall 108 close to the downstream portion 14', and by a second end wall 110 close to the main valve member 16'. The piston 100 divides the chamber 104 into a downstream half-chamber **104*a* adjacent to the first end wall 108, and an upstream half-chamber 104*b* adjacent to the second end wall 110. The first end wall 108 is pierced by a calibrated orifice 112 establishing hydraulic resistance between the half-chamber 104*a* and the inside of nozzle chamber 15, and the second end wall 110 is pierced by orifices 114 putting the upstream half-chamber 104*b* into communication with the inside of the nozzle chamber 15. The total section of these orifices is sufficient to ensure that the pressure inside the half-chamber is substantially equal to the pressure inside the chamber 15. The front face 100***a* of the piston 100 is pushed towards the second end wall 108 by a return spring 115 disposed in the upstream half-chamber 104*b* between the rear face 100*b* of the piston 100 and the second end wall 110 of the chamber 104.

The rear face 100*b* of the piston 100 is extended by a tube 116 having its axis lying on the axis XX' of the main valve member 16'. At the end 118 secured to the piston 100, the tube 116 opens out into an internal chamber 120 formed inside the piston 100. The internal chamber 120 is extended by an axial orifice 122 which opens out into the front face 100*a* of the piston 100. The axial orifice 122 defines a seat 124 for a pilot valve member 34'. The pilot valve member 34' is secured to the first end of a control rod 36' which passes through the axial orifice 122, and through an axial passage 126 formed through the first end wall 108, and then through a fluidtight feedthrough 128 formed in the wall of nozzle chamber 15. The second end of the control rod 36' is secured to a pushbutton 130 disposed outside the nozzle and provided with a return spring 132. The spring 132 urges the pilot valve member 34' against its seat 124.

With reference more particularly to FIGS. 3 and 4, it can be seen that a piece 140 which is generally in the shape of a stirrup is interposed between the upstream portion 12' of the nozzle and the chamber 15. FIG. 4 clearly shows that the piece 140 has a ring-shaped fixing base 142 with an upside-down U-shaped piece 144 standing thereon. The stirrup-shaped piece 140 is fixed at its base 142 between the upstream end wall 12' and the wall of the chamber 15. The upstream portion 12' can thus communicate with the chamber 15 only via the central hole 146 formed through the base 142 of the stirrup-shaped piece 140.

Figure 5:
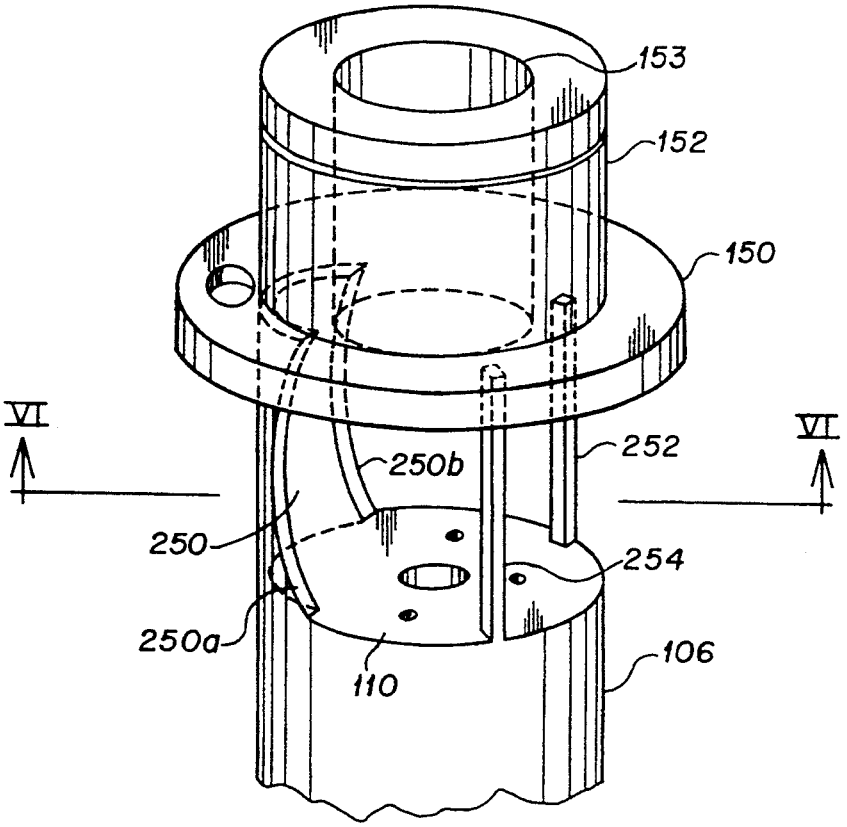
FIG. 5 is a perspective view of end piece 150 and the upper part of sleeve 106.
Figure 6:
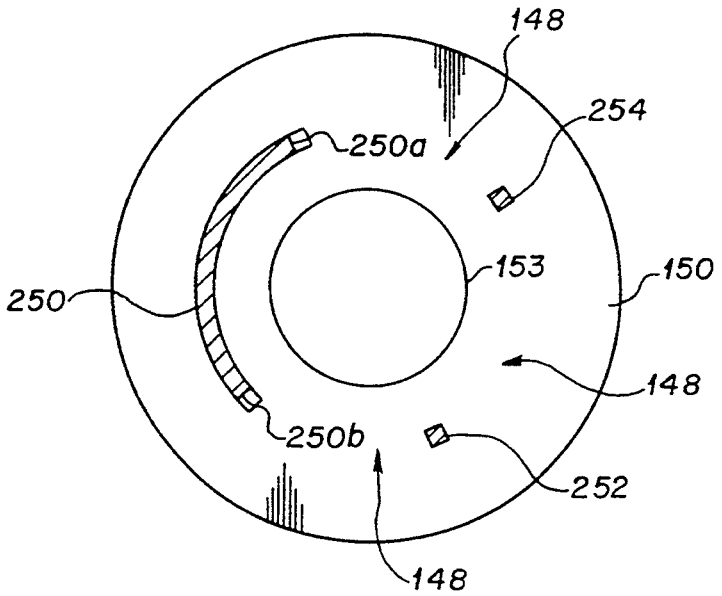
FIG. 6 is a cross section taken along line VI—VI of FIG. 5.

Returning to FIG. 2 or 3, it can be seen that the cylindrical sleeve constituting the side wall 106 of the chamber 104 extends beyond the second end wall 110 of the chamber 104. In this extension, the sleeve is provided with openings 148. These openings are formed, as best shown in FIGS. 5 and 6, by a rounded wall 250 spaced from bars, or posts, 252 and 254. Wall 250 has arcuate ends 250*a* and 250*b*.

The sleeve is terminated by an end piece 150 fixed in sealed manner on the bottom face of the base 142 of the stirrup-shaped piece 140. The end piece 150 includes a rim 152 which engages in the hole 146 through the base 142. The rim 152 provides the seat 18' for the main valve member 16' and defines an axial passage 153.

FIG. 2 shows that the second end 154 of the tube 116 passes freely through the axial orifice 20' formed in the main valve member 16'. The end 154 of the tube 116 is open and its periphery is secured to a second piston 156 disposed above the non-active face 16'*a* of the main valve member 16'. The face of the piston 156 facing the main valve member 16' is provided with a sealing ring 158 and is suitable for co-operating with the face 16'*a* of the main valve member 16'. The external surface of the tube 116 includes a small collar 160 whose outer diameter is greater than the inside diameter of the axial orifice 20' formed through the main valve member 16'. The position of the small collar 160 is such that when the front face 100*a* of the piston 100 is close to the rear face of the first end wall 108 (i.e. when the piston 100 is in its lowest position relative to the orientation of FIG. 2), and when the main valve member 16' is pressed against its seat 18', then there exists a distance x' between the collar 160 and the front face 16'*b* of the main valve member 16'. Finally, a return spring 162 is interposed between the face 16'*a* of the main valve member 16' and the horizontal portion 145 of the stirrup shape piece 140. The spring 162 thus urges the main valve member 16' against its seat 18', but it has no effect on the piston 156.

Operation of the assisted control valve shown in FIGS. 2 to 4 is now described.

So long as a user is not acting on the controlling pushbutton 130, the piston 100 is close to the downstream end 108 and both the pilot valve member 34' and the main valve member 16' are pressed against their respective seats 124 and 18'. The piston 156 is pressed in sealed manner because of the O-ring 158 against the rear face of the main valve member 16'. This ensures complete sealing which would otherwise be broken by the clearance between the inside wall of the bore 20' through the main valve member 16' and the outside face of the tube 116. The piston 100 is held in the above-described position by the return spring 115, with the restriction 112 subjecting the face 100*a* of the piston only to the low pressure that exists in the chamber 15. The pilot valve member 34' is held on its seat by the combined effects of the high pressure that exists in the internal chamber 120 via the tube 116, and of the return spring 132 of the pushbutton 130. The main valve member 16' is held against its seat 18' by the return spring 162 and by the piston 156 which is at the end of the tube 116 and which is pressed against the rear face of the main valve member 16'. In this situation, no hydrocarbon can flow from the upstream portion 12' to the chamber 15 or to the downstream portion 14'. It can be seen that if a pulse of high pressure should appear, then that pulse will merely tend to increase the force that is tending to keep the main valve member 16' and the pilot valve 34' pressed against their respective seats.

When the user desires to open the control valve, the pushbutton 130 is pushed in, thereby causing the rod 128 to lift the pilot valve member 34' off its seat 124. The high pressure liquid in the internal chamber 120 flows out through the orifice 122 into the downstream half-chamber 104*a*. Because of the restriction 112, a middle pressure MP is established in the half-chamber 104*a* which is greater than the low pressure LP that exists in the chamber 15. This middle pressure is sufficient to overcome the force developed by the return spring 116, thereby raising the piston 100. The upstream half-chamber 104*b* is at low pressure because of the orifices 144 through the end wall 110. As the piston 100 moves up, so do the tube 116 and the piston 156. The effect of this upward motion is explained below. So long as the tube 116 has not moved through the distance x', the main valve member 16' is kept against its seat by the return spring 162.

So long as the user continues to press the button 130, the tube 116 continues to move upwards and its collar 160 comes into contact with the main valve member 16', thereby causing it to open. The high pressure liquid can then flow through the seat 18' of the main valve and through the opening 148 of the sleeve 106 to penetrate into the chamber 15 and flow out through the downstream portion 14' of the dispenser nozzle.

If the user ceases to press the control button 130, the pilot valve member 34' returns to press against its seat 124. The high pressure liquid can no longer penetrate into the downstream half-chamber 104*a*. The middle pressure in half-chamber 104*a* therefore drops, causing the piston 100 to move downwards and bring the tube 116 and the collar 160 with it. The main valve member 16' can thus move back towards its seat under drive from return spring 162. When the valve member 16' reaches its seat, the collar 160 continues to follow the motion of the piston until it is again at the distance x' from the valve member 16'. If the user does not press the button 130 again, then the pilot valve member remains on its seat and the pressure in the half-chamber 104*a* continues to fall so the piston 100 returns to its initial low position, thereby closing the main valve member 16' under drive from the return spring 162. The flow of hydrocarbon to the outlet of the nozzle is thus completely interrupted.

In the above description of the second embodiment of the invention, only the assisted control of the main valve of the nozzle is described. However, this embodiment may also include an end valve which is caused to open before the main valve opens. The end valve and the chamber that directly controls opening of said valve are completely identical to the end valve 162 and the chamber 72 of FIG. 1. The following description therefore merely describes how the chamber 72 is fed with liquid under pressure when the user presses the pushbutton 130.

With reference more particularly to FIGS. 3 and 4, it can be seen that the stirrup-shaped piece 140 has various ducts formed therein that are not described above. The top face 170 of the horizontal portion 145 of the stirrup-shaped piece 140 is pierced by an axial orifice 172 which opens out into a horizontal channel 174 formed inside the portion 145 of the piece 140. The two ends of the channel 174 are respectively connected to channels 176 and 178 formed in the vertical branches 180 and 182 of the U-shaped piece 144. The channels 176 and 178 are in Darn connected to radial channels 184 and 186 formed through the base 142 of the piece 140 and opening out into the side wall of the base 142. The orifice 172 may be closed by a shutter 188 which is pressed against the face 170 of the portion 145 by a return spring 190. The return spring 190 is mounted between the top face of the shutter 188 and a bracket-forming piece 192 on the face 170.

Returning to FIG. 4, it can be seen that the shutter 188 is provided on its bottom face with two vertical fingers 194 and 196 which thus extend parallel to the axis XX' of the main valve member 16'. The free ends of the fingers 194 and 196 penetrate into vertical holes 198 and 200 formed through the horizontal portion 145 of the U-shaped piece 144. These holes 198 and 200 open out into the bottom face of the portion 145 facing the top face of the second piston 156. When the first piston 100 is in its bottom position, the free ends 194 and 196 are set back very slightly from the top face of the second piston 156.

FIG. 2 shows that the radial channel 186 is connected to the pipe 88 that feeds the chamber 72 (not shown in FIG. 2) for controlling the end valve member 62 of the nozzle (also not shown in FIG. 2). This figure also shows that the channel 176 through the piece 144 is convergent and constitutes one-half of a venturi whose other half is referenced 202. The radial channel 184 of the piece 140 opens out into the throat 204 of the venturi. The venturi associated with the channel 184 serves to detect when the vehicle tank has been filled with hydrocarbon and to prevent the pushbutton 130 being actuated under such circumstances. Since such systems are well known and do not form part of the present invention, they are not described herein.

The circuit for controlling the end valve operates as follows:

When the pushbutton 130 is at rest, the fingers 194 and 196 of the shutter 188 are not in contact with the piston 156. The channels 174, 178, and 186 and also the pipe 88 are therefore not fed with high pressure liquid, and the end valve remains closed.

When the user begins to press the pushbutton 130, the pilot valve member 34' lifts off its seat, thereby causing the first piston 100 to begin moving upwards in the manner described above. As the piston 100 moves upwards it takes the second piston 156 with it. As a result, the fingers 194 and 196 come into contact with the piston 156, thereby causing the shutter 188 to be lifted. The high pressure liquid in the upstream portion 12' of the nozzle then penetrates into the orifice 176 and, via the channels 174, 178, and 186, into the pipe 88, thereby causing the end valve to open as described with reference to FIG. 1. It should be recalled that during this initial stage, the main valve member 16' remains closed since the lost motion x' means that the collar 160 on the rod 116 has not yet come into contact with the main valve member 16'. Simultaneously, the venturi 176, 202 is fed with fluid. The shutter 188 remains open so long as the user acts on the pushbutton 130.

When the user ceases to act on the pushbutton 130, the pilot valve member 34' and then the main valve member 16' close, thereby interrupting the flow of hydrocarbon. The shutter 188 closes in turn when the first piston 100 has returned to its initial position, i.e. a short time after the main valve member 16' closes, with this time interval being defined by the lost motion x'.

It can be seen from the above description that the problems posed are solved. The external control member of the nozzle acts directly only on the pilot valve member and the section thereof subjected to high pressure is very small. The force that the user needs to exert thereon is thus also very small. In addition, the control of the end valve of the nozzle is accurately timed relative to control of the main valve of the nozzle. It therefore performs its function effectively, i.e. it prevents hydrocarbon dripping onto the ground when the nozzle is removed from the vehicle tank.

It is also important to underline that in both embodiments the main valve member 16 or 16', the pilot valve member 34 or 34', and the venturi 74 or 188 are all failsafe devices, i.e. high pressure closes them. In other words, an accidental increase in pressure can only tend to close the valves more securely.

It should finally be observed that in both embodiments, the main valve member "pursues" the pilot valve member, i.e. the pilot valve member does not merely facilitate opening of the main valve member, its own position defines the position of the main valve member, i.e. the extent to which it opens, and thus the flow rate through the nozzle.

We claim:

1. A hydrocarbon dispenser nozzle, comprising:

a main valve for interrupting the flow of hydrocarbon between an upstream portion of the nozzle and a downstream portion thereof, a pilot valve having a passage of small cross-section;

first means including an external control member acting on said pilot valve for controlling the opening and closing of said main valve in response to, respectively, opening and closing of said pilot valve; and an end valve mounted at an open end of said nozzle, and second means responsive to the opening of said pilot valve to cause said end valve to open before said main valve is opened, and responsive to closing of said pilot valve to cause said end valve to close after said main valve has closed.

2. A dispenser nozzle according to claim 1, wherein:

said external control member acts mechanically on a valve member of said pilot valve;

opening said pilot valve causes a middle pressure to be established in a chamber of said nozzle, said middle pressure lying between a high pressure in the upstream portion of the nozzle and a low pressure in the downstream portion thereof; and wherein said first means open said main valve in response to said middle pressure being established in said chamber.

3. A dispenser nozzle according to claim 1, wherein:

a seat of the main valve is disposed between said upstream and downstream portions of the nozzle;

a non-active face of a valve member of the main valve is extended by a skirt mounted to slide in a sealed manner in a chamber which is fed from the upstream portion of the nozzle via a hydraulic resistance;

the main valve member has a bore with one end opening out into the non-active face of the main valve member in the form of a seat of the pilot valve; and a first mechanical member passing through said bore controls the opening of a valve member of the pilot valve in response to said external control member being actuated.

4. A dispenser nozzle according to claim 3, further including a second mechanical member actuated by said external control member to control opening of an auxiliary valve, with opening of said auxiliary valve putting said upstream portion of the nozzle into communication with a control chamber, and said second means being responsive to feed of hydrocarbon to said control chamber for causing an end valve disposed at the open end of said nozzle to be opened.

5. A dispenser nozzle according to claim 4, wherein actuating said external control member causes said second mechanical member to be actuated before said first mechanical member is actuated.

6. A dispenser nozzle according to claim 1, wherein:

a valve member of said main valve co-operates with a main seat disposed between said upstream portion and a main chamber connected to said downstream portion;

said external control member is connected to a first mechanical member for causing said pilot valve to open in response to said external control member being actuated;

said main chamber comprises a downstream chamber closed by a first moving piston;

opening said pilot valve causes said downstream chamber to be fed with liquid at a middle pressure lying between the high pressure of said upstream portion and the low pressure of said downstream portion, said middle pressure being suitable for moving said first piston;

said nozzle further includes a second mechanical member actuated by said first piston moving; and actuation of said second mechanical member causes said main valve member to move away from said main seat.

7. A dispenser nozzle according to claim 6, wherein said first piston includes an internal chamber communicating with the downstream chamber via an orifice forming a seat for a valve member of said pilot valve, which valve member is mounted inside said internal chamber, said internal chamber being connected at a first end to a rigid tube constituting said second mechanical member, said tube passing freely through said main valve member via a bore formed therethrough, the second end of said tube being open and being fed permanently with the high pressure liquid in the upstream portion of the nozzle.

8. A dispenser nozzle according to claim 7, further including an auxiliary valve for controlling the flow of high pressure liquid from the upstream portion of the nozzle into a duct, a control chamber connected to said duct, and an end valve disposed at the open end of said nozzle, said end valve being opened by said high pressure liquid penetrating into said control chamber, and a third mechanical member co-operating with the second end of said tube, said third mechanical member being suitable for opening said auxiliary valve when said first piston moves.

* * * * *